US005170615A

United States Patent [19]

Strahlen et al.

[11] Patent Number: 5,170,615

[45] Date of Patent: Dec. 15, 1992

[54] TEXTILE YARN PROCESSING MACHINE HAVING SOUNDPROOFING PANELING ELEMENTS

[75] Inventors: Dieter Strahlen, Dormagen; Jürgen Kallamann, Kaarst; Heinz Fink, Krefeld, all of Fed. Rep. of Germany

[73] Assignee: Palitex Project Company GmbH, Krefeld, Fed. Rep. of Germany

[21] Appl. No.: 654,765

[22] Filed: Feb. 12, 1991

[30] Foreign Application Priority Data

Feb. 13, 1990 [DE] Fed. Rep. of Germany ..... 4004339

[51] Int. Cl.[5] ..... D01H 11/00; D01H 13/26; D01H 5/28

[52] U.S. Cl. ..... 57/1 R; 57/304; 57/308

[58] Field of Search ..... 57/58, 49, 261, 263, 57/264, 268, 276, 308, 406, 407, 304, 1 R

[56] References Cited

U.S. PATENT DOCUMENTS

| | | | |
|---|---|---|---|
| 3,146,572 | 9/1964 | Keyser | 57/1 R |
| 3,362,148 | 1/1968 | Hofstetter | 57/308 X |
| 3,391,528 | 7/1968 | Shackelford | 57/308 X |
| 3,665,694 | 5/1972 | Ford et al. | 57/308 X |
| 3,816,987 | 6/1974 | Hofstetter | 57/308 |
| 4,570,743 | 2/1986 | Wetter | 57/1 R |
| 4,586,323 | 5/1986 | Lassiter et al. | 57/261 X |
| 4,865,260 | 9/1989 | Colli et al. | 57/268 X |

FOREIGN PATENT DOCUMENTS

| | | |
|---|---|---|
| 7105081 | 5/1971 | Fed. Rep. of Germany . |
| 1685887 | 1/1975 | Fed. Rep. of Germany . |
| 7530470 | 1/1976 | Fed. Rep. of Germany . |

*Primary Examiner*—Daniel P. Stodola
*Assistant Examiner*—Michael R. Mansen
*Attorney, Agent, or Firm*—Bell, Seltzer, Park & Gibson

[57] ABSTRACT

A textile yarn processing machine, in particular a yarn twisting machine, having a plurality of spindle assembly working positions, which is enclosed on both longitudinal sides over its full height with a soundproofing cover comprising several paneling elements which are movable for partially overlapping each other. Between the paneling elements and the working positions of the machine, maintenance units are arranged, which are able to move also in the closed condition of the paneling elements.

14 Claims, 3 Drawing Sheets

TEXTILE YARN PROCESSING MACHINE HAVING SOUNDPROOFING PANELING ELEMENTS

FIELD OF THE INVENTION

This invention relates to a textile yarn processing machine, particularly a yarn twisting machine including a two-for-one yarn twisting machine, having a longitudinally extending frame, a plurality of spindle assembly working positions in side-by-side relationship along the length of the machine, at least one movable maintenance unit suspended from the machine frame and movable in the longitudinal direction of the machine along the outside of the spindle assembly positions, and including the improvement of a plurality of paneling elements forming a part of a soundproofing cover shielding the machine.

BACKGROUND OF THE INVENTION

A textile machine with such a maintenance unit, which is designed and constructed as a traveling blower, is described, for example, in German published application DE-OS 16 85 887.

In the known apparatus, the covering elements arranged on the longitudinal sides of the machine, which can be raised and lowered in vertical direction, serve only to guide the air current flowing from the traveling blower, so as to cover as completely as possible the entire interior of the machine, whereas no sound insulation is provided.

However, in modern textile machines a considerable need exists for providing noise abatement, so as to reduce the noise level, which the machine generates in the room. Devices for reducing the noise level are known per se and described, for example, in German published application DE-OS 25 42 930 and German Utility Model Patent GM 71 05 081. However, these known devices are not equipped with maintenance units.

OBJECT AND SUMMARY OF THE INVENTION

It is the object of the present invention to perfect a textile machine of the type described above such that as complete as possible soundproofing is obtained on the one hand, and that at least one maintenance unit is present on the other hand, which is not impeded by the soundproofing elements, but cooperates with same.

According to the present invention, this object is accomplished by providing a plurality of paneling elements forming a part of a soundproofing cover shielding the above described type of machine and which further includes means for movably suspending the paneling elements from the machine frame for movement in the longitudinal direction of the machine outside of the movable maintenance unit to permit movement of the maintenance unit within the paneling elements. Each of the paneling elements has dimensions for extending generally the height of the machine and a sufficient portion of the length of the machine so as to collectively cover all of the spindle assembly positions. The suspending means further adapts the paneling elements for moving into consecutive partially overlapping positions to cover all of the spindle assembly positions while allowing selective uncovering of particular spindle assembly positions.

Preferably, the suspending means comprises a rail having individual tracks therein for suspending the movable maintenance unit and the paneling elements, respectively. The textile yarn processing machine is preferably the type which includes spindle assembly working positions extending side-by-side on each longitudinal side of the textile machine in parallel relationship and the suspending means preferably comprises at least two guide rails extending parallel to each other on the upper portions of the machine for suspending the paneling elements therefrom along both of the longitudinal sides of the machine.

The textile machine may further include a drive mechanism positioned on one or both ends of the machine and the plurality of paneling elements preferably includes at least one paneling element, in addition to the paneling element required for collectively covering all of the spindle assembly positions along the longitudinal side of the machine, for being positioned in front of the drive element. The paneling elements may preferably comprise transparent material. The yarn processing machine is preferably closed at its upper region by a cover which extends outwardly to the paneling elements. The paneling elements may be moved by an electric or pneumatic drive device or means may be associated with a maintenance unit for effecting movement of the paneling elements.

The basic concept of the present invention is to entirely cover the textile machine for the purpose of obtaining a particularly good sound insulation, and to arrange the maintenance elements inside the soundproofed enclosure such that they fulfill their function also when the interior is closed.

The device of the present invention is extremely flexible in its setup and allows an optimal utilization of the available space. The paneling elements sliding in the longitudinal direction of the machine themselves permit a particularly good organization of the batchwise servicing on the machine, primarily when an additional paneling element is arranged on each longitudinal side of the machine, so that the overall length of the available paneling elements is greater than the entire length of the working positions present on the machine. The additional paneling element is first arranged in front of one of the two drive elements at the ends of the machine. When the machine is in need of service, it is possible to push the first paneling element in direction toward the free drive element of the machine. When the next section of the machine is serviced, the second paneling element is pushed to the first section, and the procedure thus continues up to the last section. Since the additional paneling element is located in front of the drive element arranged on the other machine end, it is possible to push same again in front of the working section being serviced last, and the machine is again entirely closed. The next operating step will then proceed in the reversed order.

Depending on the size of the available paneling elements, it is possible to assist their movement electrically or pneumatically. It may likewise be effected by the maintenance units.

For the purpose of providing a good sound insulation, it will be useful to arrange an absorbent material in the interior of the machine, with the center of the machine, which is free of working positions. However, it is also possible to use the cover or the floor.

The total enclosure of the machine according to the present invention has the additional advantage of an increased accident prevention, and can moreover be utilized to air condition the interior of the machine by arranging, for example, an air conditioning duct on the upper side of the cover, which cooperates, for example, with an air return device in the form of an exhaust air duct, it being possible to direct the flow of the conditioned air through the machine either from the region of the ceiling in direction of the exhaust duct or, however, also vice versa.

The maintenance units arranged inside the soundproofing enclosure can be a cleaning device equipped with blow or suction nozzles, on the one hand, and a maintenance unit for equipping or servicing the individual working positions, on the other.

BRIEF DESCRIPTION OF THE DRAWINGS

An embodiment of a textile machine according to the present invention will be described below in more detail with reference to the attached drawings, in which.

DETAILED DESCRIPTIONS OF PREFERRED EMBODIMENT OF THE INVENTION

Figure 1:
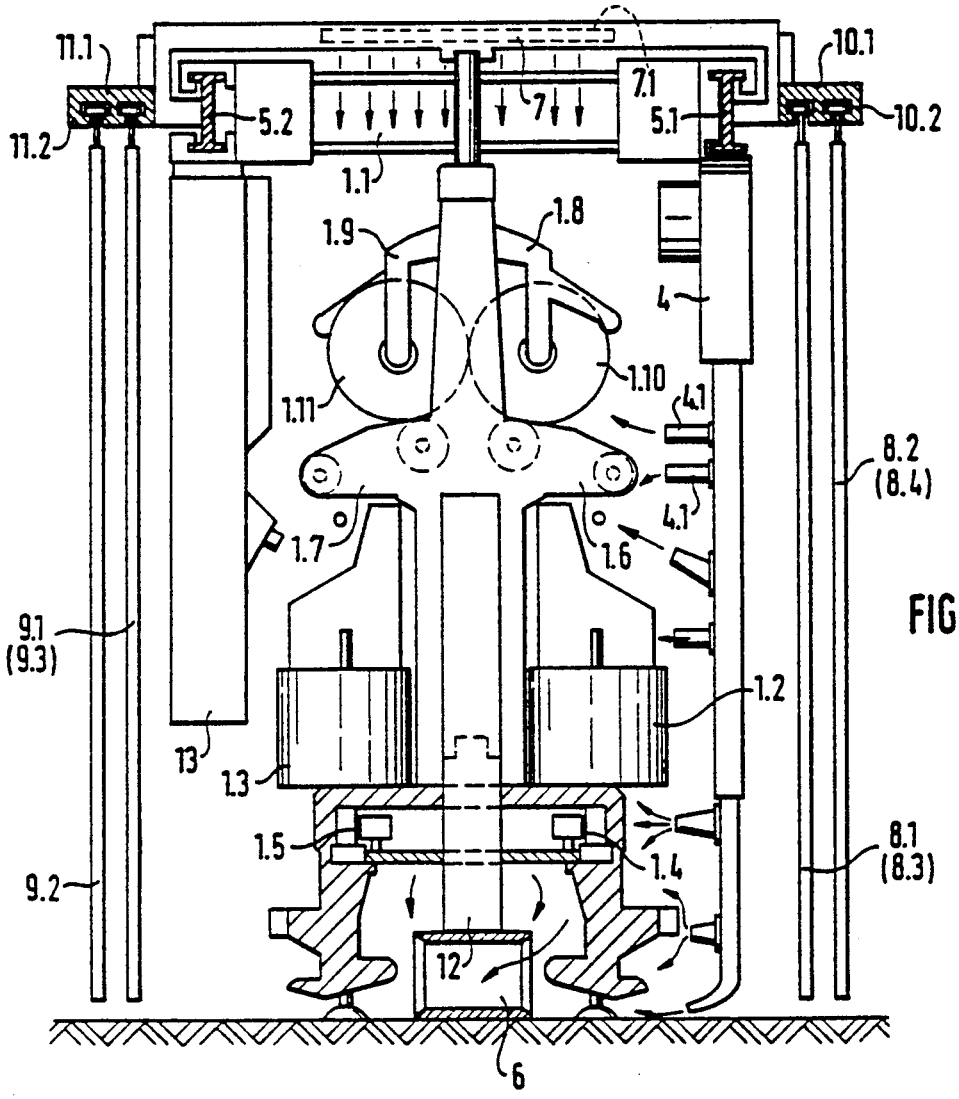
FIG. 1 is a cross sectional view of a two-for-one twisting machine comprising a soundproofing cover and maintenance units.
Figure 2:
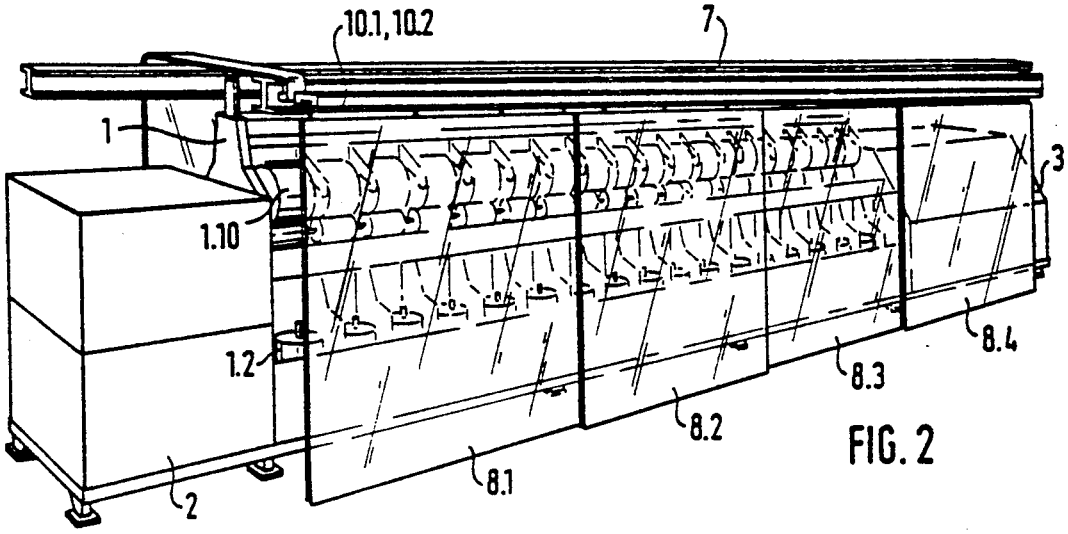
FIG. 2 is a perspective side elevation of the machine of FIG. 1.

Illustrated in FIGS. 1 and 2 is a double-sided two-for-one twister comprising a machine frame 1, which accommodates in the usual manner twisting spindles 1.2 and 1.3 with spindle drives 1.4 and 1.5 as well as support plates 1.6 and 1.7 for the takeup units, and package holders 1.8 and 1.9 for the crosswound packages 1.10 and 1.11.

Mounted on the upper end of the machine frame 1 are both a cover 7 extending over the entire machine length and longitudinal beams 5.1 and 5.2 supported on cross beams 1.1. A traveling blower 4 of a known type and serving as a maintenance unit suspends displaceably from one longitudinal beam 5.1 and moves along same. The traveling blower 4 is equipped with air outlet nozzles 4.1 facing the interior of the machine. A servicing automat 13 serving as a maintenance unit suspends from the other longitudinal beam 5.2 and is likewise adapted for displacement and movement along the latter.

Furthermore, on the two longitudinal edges of the cover 7, double rails 10.1–10.2 and 11.1–11.2 extending in the longitudinal direction of the machine are arranged, from which paneling elements 8.1, 8.2, 8.3 as well as 9.1, 9.2, 9.3 (not shown in FIG. 2) suspend. These paneling elements may consist of a transparent material, and their movement may be effected or assisted by electrical or pneumatic drive means.

In the embodiment shown in FIG. 1, the traveling blower 4 and the servicing automat 13 as well as the paneling elements 8.1–8.3 and 0.1–9.3 suspend each from their own rails. Naturally, also constructions are conceivable, in which the traveling blower and the paneling elements or the servicing automat suspend from a common combination rail.

As can be seen in FIG. 2, drive elements 2 and 3 are arranged at both ends of the machine.

The paneling elements are arranged in the guide rails 10.1. one alternating with the other, such that, for example, the paneling elements 8.1 and 8.3 slide in the guide rail 10.1 and the paneling element 8.2 in the guide rail 10.2. In this manner, it is possible to slide two paneling elements each, one overlapping the other in full or in part. Furthermore, an additional paneling element is provided on both sides, which is indicated at 8.4 in FIG. 2 and arranged therein, for example, in front of the drive element 3. Its function will be explained in more detail further below.

Naturally, it is also possible to arrange triple rails on each machine side and to hang thereon the paneling elements one alternating with the other. In this event, it becomes possible to expose a large area of the machine interior for servicing.

Arranged inside the machine enclosed by the soundproofing cover, preferably in the center of the machine, is a sound absorbing material 12. An exhaust air duct 6 arranged on the floor in the machine center and extending in the longitudinal direction, serves to return the air, which is blown by the traveling blower 4 into the interior space. This exhaust air duct may simultaneously be used for air conditioning the interior of the machine. To this end, the cover 7 is simultaneously provided with an air conditioning duct 7.1, so that the flow of the conditioned air can be directed from top to bottom throughout the entire machine.

To service the machine, for example, from the right side of FIG. 1, one can proceed as follows. First, the first paneling element 8.1 is moved to the left in front of the drive element 2. After servicing the thus exposed section of the machine, the paneling element 8.2 in FIG. 2 is pushed to the left to the place where the paneling element 8.1 was before. After servicing this section, the paneling element 8.3 is likewise pushed to the left to the place where the paneling element 8.2 was before. Finally, after servicing the last section, the additional paneling element 8.4 is pushed to the place which was occupied before by the paneling element 8.3. Now, the entire longitudinal side of the machine is again covered. The next servicing procedure on this side will start at the end where the paneling element 8.4 is located, which is then again pushed back in front of the drive element 3. The procedure on the other machine side is analogous.

Figure 3:
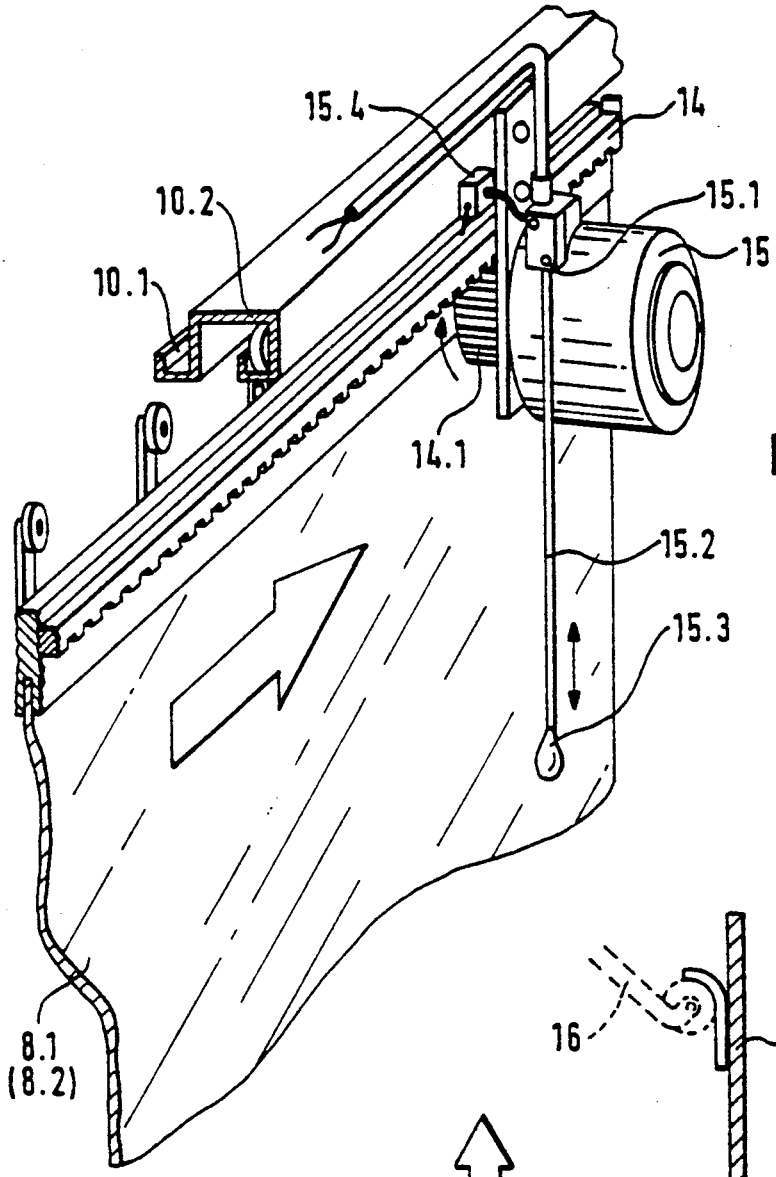
FIG. 3 is a perspective partial side elevation of a first variant of the machine according to FIGS. 1 and 2.

In principle, the paneling elements 8.1–8.3 and 9.1–9.3 can be moved by hand. However, as aforesaid, it is also possible to effect their movement by a special drive means. Such a variant of the machine described with reference to FIGS. 1 and 2 is shown in FIG. 3. For reasons of a simplified illustration, FIG. 3 shows only a partial section of the double rails 10.1–10.2, from which the paneling elements 8.1 and 8.2 suspend. At the upper end of the paneling elements, for example, the paneling element 8.1, a rack 14 is arranged extending in the longitudinal direction. Further, an electric motor 15 is mounted on the double rail 10.1–10.2, Whose drive shaft not shown accommodates a pinion 14.1, which engages with the rack 14. An on-off switch 15.1, whose switching element not shown is connected with a tie rod 15.2 with a handle 15.3 at its end, starts and stops the electric motor 15. Naturally, it is also possible to replace the tie rod 15.2 with a switching bar. For safety reasons, a limit switch 15.4 is additionally arranged in the region of the guide rails 10.1–10.2, Which causes the movement of the paneling element to be stopped at the latest in a predetermined end position.

Naturally, it is also possible to use a pneumatic motor 15' of a known type in the place of the electric motor 15. This pneumatic motor includes an off-on switch 15.1', a tie rod 15.2' with handle 15.3', a limit switch 15.4' and a fluid supply hose 15.5'.

Likewise, it is possible not to move the paneling elements 8.1–8.3 or 9.1–9.3 respectively by their own drive motor. but by a maintenance unit, such as, the traveling blower 4 shown in FIG. 1 or the servicing automat 13. Such a variant is shown in FIG. 4.

Figure 4:
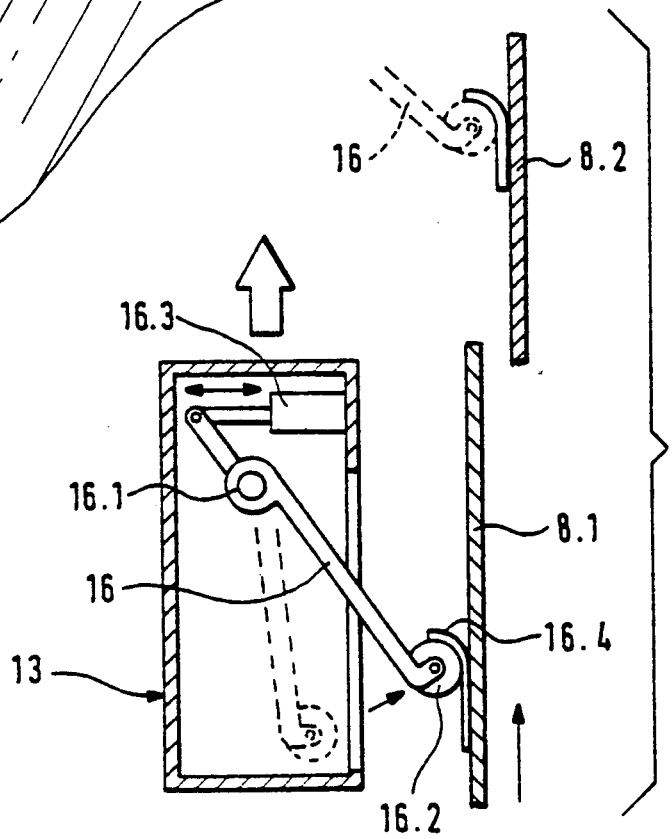
FIG. 4, is a vertical partial sectional view of a second variant of the machine according to FIGS. 1 and 2 in the region of a servicing automat.

FIG. 4 relates to the right side of the machine in FIG. 1 and to the movement of the paneling elements 8.1–8.3. The movement of these paneling elements is effected by a servicing automat 13. To this end, it is assumed that the machine shown in FIG. 1 does not have a servicing automat 13 only on its left side, but also on its right side, which suspends, for example, from the longitudinal beam 5.1. Arranged in the servicing automat 13 is a pivot lever 16 rotatable about a vertical axis 16.1, which can be swung by actuating a pneumatic cylinder 16.3 out of the housing of the servicing automat 13 in direction toward the inner side of the paneling element 8.1 or 8.2 respectively. Arranged at the outer end of the pivot lever 16, via a rotatable roll 16.2, is a carrier element 16.4, which is provided on its side facing the paneling element 8.1 with a friction coating having a predetermined coefficient of friction. When the pivot lever 16 is swung out, the carrier element 16.4 comes to lie against the inner side of the paneling element 8.1. Since the carrier element 16.4 can be moved over the rotatable roll, it is able to lie flat against the outside of the paneling element, and as a result of friction the paneling element 8.1 is entrained in the direction of the arrow, when the servicing automat 13 moves in the direction of the arrow. The same applies to the entrainment of the other paneling element 8.2, as is indicated in the upper portion of FIG. 4. When the entrained paneling element reaches its end position, the pivot lever 16 is swung away from the paneling element by means of the pneumatic cylinder 16.3, so that the servicing automat is able to move on without entraining the paneling element.

What is claimed is:

1. In a textile yarn processing machine, particularly a yarn twisting machine, having a longitudinally extending frame, a plurality of spindle assembly working positions in side-by-side relationship along the length of said machine, at least one movable maintenance unit suspended from said machine frame and movable in the longitudinal direction of said machine along the outside of said spindle assembly positions; the combination therewith of:

a plurality of soundproofing paneling elements forming a part of a soundproofing cover shielding said machine and each having dimensions for extending generally the height of said machine and a sufficient portion of the length of said machine so as to collectively cover all of said spindle assembly positions; and means for movably suspending said paneling elements from said machine frame for movement in the longitudinal direction of said machine outside of said movable maintenance unit to permit movement of said maintenance unit within said paneling elements and for movement along said suspending means into consecutive partially overlapping positions to cover all of said spindle assembly positions and into other positions for allowing selective uncovering of particular spindle assembly positions whereby said maintenance unit can perform maintenance functions when all of said spindle assembly positions are covered and so that selected spindle assembly positions can be serviced when uncovered.

2. In a textile yarn processing machine, as set forth in claim 1, in which said suspending means comprises a rail having individual track means therein for suspending said movable maintenance unit and said paneling elements, respectively.

3. In a textile yarn processing machine, as set forth in claim 1, in which at least one said maintenance unit comprises a cleaning device having blowing or suction nozzles thereon.

4. In a textile yarn processing machine, as set forth in claim 1, in which at least one said maintenance unit comprises a servicing unit for servicing individual spindle assembly working positions.

5. In a textile yarn processing machine, as set forth in claim 1, in which said spindle assembly working positions extend side-by-side on each longitudinal side of said textile yarn processing machine in parallel relationship and said suspending means comprises at least two guide rails extending parallel to each other on the upper portion of the machine for suspending said paneling elements therefrom along both of longitudinal sides of said machine.

6. In a textile yarn processing machine, as set forth in claim 1 or 5, in which said textile yarn processing machine further includes at least one drive mechanism positioned at an end of said machine, and in which said plurality of paneling elements further includes at least one paneling element, in addition to said paneling elements required for collectively covering all of said spindle assembly positions along the longitudinal side of said machine, for being positioned in front of said drive element.

7. In a textile yarn processing machine, as set forth in claim 1 or 5, in which said paneling elements comprise transparent material.

8. In a textile yarn processing machine, as set forth in claim 1 or 5, further including sound absorbent material positioned in predetermined locations of said machine inside of said paneling elements.

9. In a textile yarn processing machine, as set forth in claim 1 or 5, in which said yarn processing machine is closed at its upper region by a cover which extends outwardly to said paneling elements.

10. In a textile yarn processing machine, as set forth in claim 9, further including an air conditioning duct positioned in said cover for supplying air to said machine.

11. In a textile yarn processing machine, according to claim 10, further including an air duct positioned generally in the center of said machine in the region of the bottom of said machine for exhausting air from said machine.

12. In a textile yarn processing machine, according to claim 1 or 5, in which said improvement further includes electric drive means operatively connected with said paneling elements for moving said paneling elements.

13. In a textile yarn processing machine, according to claim 1 or 5, further including means associated with said maintenance unit for effecting movement of said paneling elements.

14. In a textile yarn processing machine, according to claim 1 or 5, further including pneumatic drive means operatively connected with said paneling elements for moving said paneling elements.

* * * * *

UNITED STATES PATENT AND TRADEMARK OFFICE

CERTIFICATE OF CORRECTION

PATENT NO. : 5,170,615

DATED : December 15, 1992

INVENTOR(S) : Strahlen, et al

It is certified that error appears in the above-identified patent and that said Letters Patent is hereby corrected as shown below:

Title page, item [75]

INVENTORS:

"Kallamann" should be -- Kallmann --.

Figure 3A:
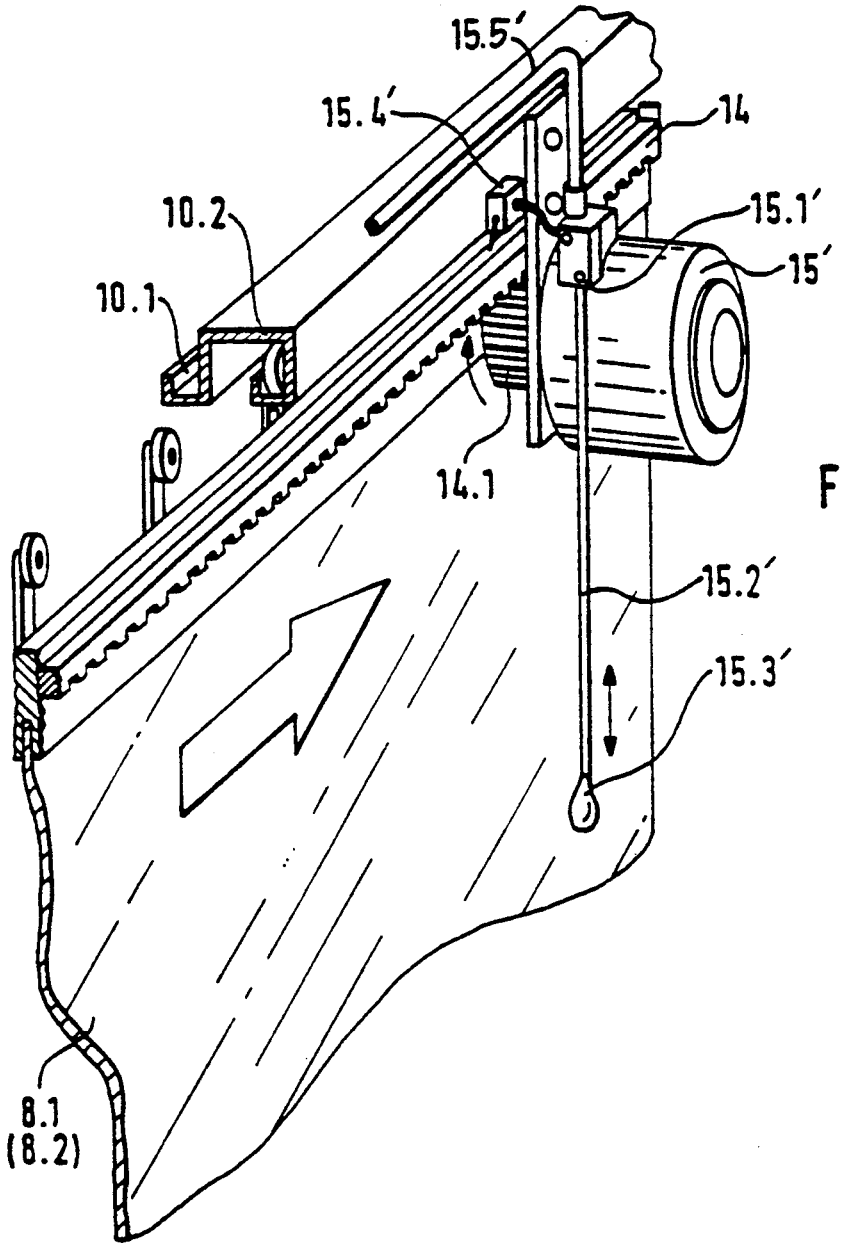
FIG. 3*a* is a view, like FIG. 3, but illustrating a pneumatic motor and drive in lieu of the electric motor and drive illustrated in FIG. 3.

Column 3, lines 28-30, "Fig. 3a is a view, illustrated in Fig. 3;" should be inserted after -- 2; --on line 24--.

Column 3, line 62, "0.1-9.3" should be -- 9.1-9.3 --.

Column 4, line 58, "Whose" should be -- whose --.

Column 4, line 66, "Which" should be -- which --.

Signed and Sealed this

Thirtieth Day of November, 1993

Bruce Lehman

*Attest:*

BRUCE LEHMAN

*Attesting Officer*

*Commissioner of Patents and Trademarks*